US010059417B1

(12) United States Patent
Hilbert et al.

(10) Patent No.: US 10,059,417 B1
(45) Date of Patent: Aug. 28, 2018

(54) MARINE PROPULSION DEVICE WITH HYDROLOCK AND STALL PREVENTION

(71) Applicant: Brunswick Corporation, Lake Forest, IL (US)

(72) Inventors: David J. Hilbert, Black Creek, WI (US); Brian J. Fregonese, Fond du Lac, WI (US); Christopher R. Jenks, Rosendale, WI (US)

(73) Assignee: Brunswick Corporation, Mettawa, IL (US)

( * ) Notice: Subject to any disclaimer, the term of this patent is extended or adjusted under 35 U.S.C. 154(b) by 173 days.

(21) Appl. No.: 15/357,725

(22) Filed: Nov. 21, 2016

(51) Int. Cl.

| | |
|---|---|
| ***B63H 21/14*** | (2006.01) |
| ***F02B 61/04*** | (2006.01) |
| ***F02N 11/04*** | (2006.01) |
| ***F02N 11/08*** | (2006.01) |
| ***B63H 21/21*** | (2006.01) |

(52) U.S. Cl.
CPC ..... *B63H 21/14* (2013.01); *B63H 21/21* (2013.01); *B63H 21/213* (2013.01); *F02B 61/04* (2013.01); *F02N 11/04* (2013.01); *F02N 11/08* (2013.01); *B63H 2021/216* (2013.01)

(58) Field of Classification Search
CPC ..... B63H 21/14; B63H 21/213; B63H 21/21; B63H 2021/216; F02N 11/04; F02N 11/08; F02B 61/04
See application file for complete search history.

(56) References Cited

U.S. PATENT DOCUMENTS

| | | | | |
|---|---|---|---|---|
| 6,011,377 | A | 1/2000 | Heglund et al. | |
| 6,098,584 | A | 8/2000 | Ahner et al. | |
| 6,109,986 | A | 8/2000 | Gaynor et al. | |
| 6,699,081 | B1 * | 3/2004 | Divljakovic | F02B 61/045 440/1 |
| 6,942,530 | B1 | 9/2005 | Hall et al. | |
| 8,439,800 | B1 | 5/2013 | Bazan et al. | |
| 8,574,019 | B2 * | 11/2013 | Kuriyagawa | B63H 20/20 440/1 |
| 9,043,058 | B1 | 5/2015 | Camp et al. | |
| 9,103,287 | B1 | 8/2015 | Arbuckle et al. | |
| 2014/0187107 | A1 * | 7/2014 | Gemin | B63H 21/22 440/3 |

FOREIGN PATENT DOCUMENTS

| | | |
|---|---|---|
| EP | 0352296 B1 | 1/1990 |

* cited by examiner

*Primary Examiner* — Joseph Dallo
*Assistant Examiner* — Kurt Liethen
(74) *Attorney, Agent, or Firm* — Andrus Intellectual Property Law, LLP

(57) ABSTRACT

A marine propulsion device includes an internal combustion engine driving a driveshaft into rotation and a starter-generator motor in a torque transmitting relationship with the driveshaft. The starter-generator motor is alternately operable in a positive torque mode where it is powered by a battery to exert a positive torque on the driveshaft, and in a negative torque mode where it exerts a negative torque on the driveshaft and generates a charge to the battery. A control module is configured to receive an engine RPM, determine an engine RPM drop rate, and determine that the engine RPM drop rate exceeds a threshold drop rate. The starter-generator motor is then operated in a positive torque mode based on the engine RPM drop rate when the engine RPM drop rate exceeds the threshold drop rate.

20 Claims, 6 Drawing Sheets

MARINE PROPULSION DEVICE WITH HYDROLOCK AND STALL PREVENTION

FIELD

The present disclosure relates to marine propulsion devices, and more specifically to marine propulsion devices having electric starter-generator motors, and methods for controlling the same in order to prevent hydrolock and/or to facilitate shifting to reverse gear.

BACKGROUND

The following Patents and Applications provide background information and are incorporated herein by reference in entirety.

U.S. Pat. No. 6,098,584 discloses the starter apparatus for an internal combustion engine including a starter-generator including a device for rotating a flywheel to a predetermined rotational speed and a device for rotating the crankshaft of the engine to directly start the engine; at least one clutch for directly coupling or disengaging the flywheel with the crankshaft of the engine so that the flywheel starts the engine with the rotational energy stored in the flywheel by the starter-generator in an impulse starting method and a changeover device for changing between the impulse starting method based on engagement of the flywheel with the engine and a direct starting method in which the starter-generator is directly coupled to the engine, wherein the changeover device switches between the direct starting method and the impulse starting method as a function of a temperature of the engine so that the impulse starting method is used at comparatively lower temperatures and the direct-starting method is used at comparatively higher temperatures. The starter apparatus also includes a device for adaptively determining the threshold for changeover between impulse starting and direct starting.

U.S. Pat. No. 6,109,986 discloses an idle speed control system for a marine propulsion system that controls the amount of fuel injected into the combustion chamber of an engine cylinder as a function of the error between a selected target speed and an actual speed. The speed can be engine speed measured in revolutions per minute or, alternatively, it can be boat speed measured in nautical miles per hour or kilometers per hour. By comparing target speed to actual speed, the control system selects an appropriate pulse with length for the injection of fuel into the combustion chamber and regulates the speed by increasing or decreasing the pulse width.

U.S. Pat. No. 6,699,081 discloses a switch reluctance device that is used as a starter/generator for an outboard motor. The rotor of the switch reluctance device is attached to the crankshaft of the internal combustion engine and serves as a flywheel for the engine. The switch reluctance device is operated in a motoring mode when it is used as a starter motor for the internal combustion engine. The switch reluctance device is operated in an electrical power generating mode when the internal combustion engine is operating above a predetermined operating speed.

U.S. Pat. No. 6,942,530 discloses an engine control strategy for a marine propulsion system that selects a desired idle speed for use during a shift event based on boat speed and engine temperature. In order to change the engine operating speed to the desired idle speed during the shift event, ignition timing is altered and the status of an idle air control valve is changed. These changes to the ignition timing and the idle air control valve are made in order to achieve the desired engine idle speed during the shift event. The idle speed during the shift event is selected so that the impact shock and resulting noise of the shift event can be decreased without causing the engine to stall.

U.S. Pat. No. 9,043,058 discloses methods and systems are for facilitating shift changes in a marine propulsion device having an internal combustion engine and a shift linkage that operatively connects a shift control lever to a transmission for effecting shift changes amongst a reverse gear, a neutral gear and a forward gear. A position sensor senses position of the shift linkage. A speed sensor senses speed of the engine. A control circuit compares the speed of the engine to a stored engine speed and modifies, based upon the position of the shift linkage when the speed of the engine reaches the stored engine speed, a neutral state threshold that determines when the control circuit ceases reducing the speed of the engine to facilitate a shift change.

U.S. Pat. No. 9,103,287 discloses drive-by-wire control systems and methods for a marine engine that utilize an input device that is manually positionable to provide operator inputs to an engine control unit (ECU) located with the marine engine. The ECU has a main processor that receives the inputs and controls speed of the marine engine based upon the inputs and a watchdog processor that receives the inputs and monitors operations of the main processor based upon the inputs. The operations of the main processor are communicated to the watchdog processor via a communication link. The main processor causes the watchdog processor to sample the inputs from the input device at the same time as the main processor via a sampling link that is separate and distinct from the communication link. The main processor periodically compares samples of the inputs that are simultaneously taken by the main processor and watchdog processor and limits the speed of the engine when the samples differ from each other by more than a predetermined amount.

European Patent No. 0352296 discloses a spark ignition interrupt system for a marine propulsion internal combustion engine to reduce engine speed and facilitate shifting of a marine propulsion transmission. Spark ignition is terminated in response to a given shift condition until engine speed drops below a given cut-in speed or until completion of the shifting, whichever occurs first. A stall interval is also started in response to the given shift condition. The engine is stalled upon completion of the stall interval if the shifting is not complete, even if engine speed has dropped below the given cut-in speed.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a marine propulsion device includes an internal combustion engine driving a driveshaft into rotation and a starter-generator motor in a torque transmitting relationship with the driveshaft. The starter-generator motor is alternately operable in a positive torque mode where it is powered by a battery to exert a positive torque on the driveshaft, and in a negative torque mode where it exerts a negative torque on the driveshaft and generates a charge to the battery. A control module is configured to receive an engine RPM, determine an engine RPM drop rate, and determine that the engine RPM drop rate exceeds a threshold drop rate. The starter-generator motor is then operated in a positive torque mode based on the engine RPM drop rate when the engine RPM drop rate exceeds the threshold drop rate.

One embodiment of a method of controlling a starter-generator motor on a marine propulsion device, wherein the starter-generator motor is alternately operable in a positive torque mode where it is powered by a battery to exert a positive torque on the driveshaft and in a negative torque mode where it exerts a negative torque on the driveshaft and generates a charge to the battery, includes receiving an engine RPM and determining an engine RPM drop rate. The engine RPM drop rate is then compared to a threshold drop rate to determine whether the engine RPM drop rate exceeds the threshold drop rate. The starter-generator motor is operated in a positive torque mode based on the engine RPM drop rate when the engine RPM drop rate exceeds the threshold drop rate.

Various other features, objects, and advantages of the invention will be made apparent from the following description taken together with the drawings.

BRIEF DESCRIPTION OF THE DRAWINGS

The present disclosure is described with reference to the following FIGURES.

DETAILED DESCRIPTION

Figure 1:
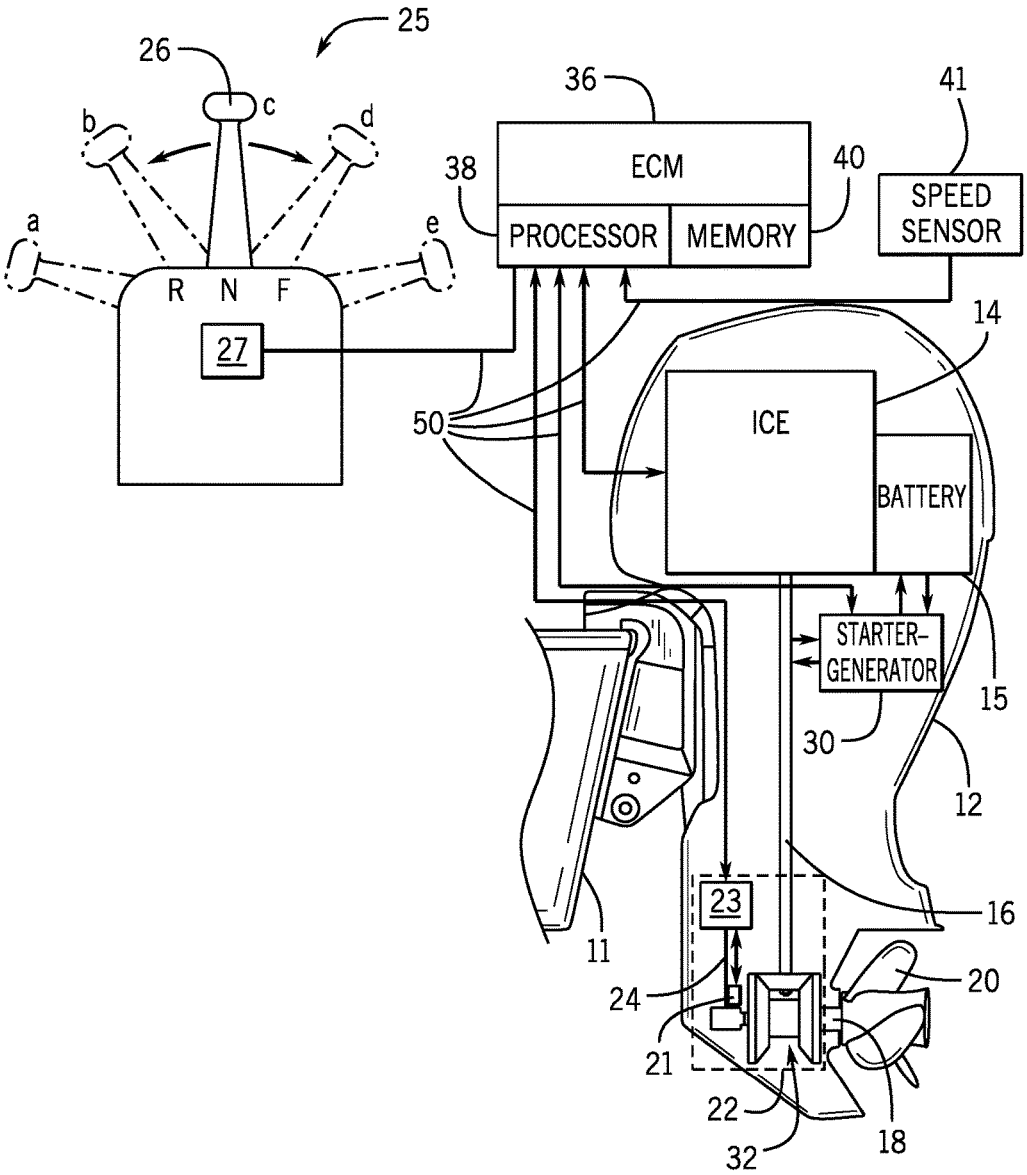
FIG. 1 depicts one embodiment of a marine propulsion device in accordance with the present disclosure.

Four stroke marine engines can ingest water through the exhaust causing hydrolock if they are suddenly shifted into reverse gear while the boat is moving forward at a sufficiently high speed. Namely, if the engine stalls while in reverse gear and the marine vessel is traveling forward relatively fast (e.g., more than 10 mph), water forces acting on the propeller cause the propeller to continue rotating forward despite the gearcase being in the reverse position. This causes the engine to rotate backwards and the pistons to draw water up the exhaust and into the cylinders. Avoiding such a hydrolock event is highly desirable because it causes significant damage to the engine.

When a gear system of a marine vessel, such as a clutch or transmission, are shifted from neutral into a reverse gear position, significant torque is required to initiate movement of the propeller in the reverse rotational direction—i.e., into the direction that effectuates a thrust to propel the marine vessel in a reverse, or backwards, direction. This is especially true where a marine vessel is traveling at a relatively high speed in the forward direction and the operator suddenly shifts into reverse (e.g., as a panicked reaction to slow down the marine vessel as quickly as possible), because the forward direction momentum of the propeller shaft will need to be overcome and rotation in the opposite direction will need to be initiated. Often the engine combustion strategy cannot respond quickly enough and there is a significant delay in the throttle response, and thus the torque output demanded by the user is not met for a period of time. The inventors have recognized that, in such situations, a starter-generator motor can be used to exert torque on the driveshaft to supplement or to replace the torque supplied by the engine until such time as the combustion strategy for the engine can catch up to the demand. In other words, the starter-generator motor is utilized under certain conditions described herein to add torque to the driveshaft in order to keep the driveshaft (and thus the propeller) moving in the correct direction, thereby preventing the engine from stalling and/or preventing hydrolock.

Additionally, the inventors have recognized the starter-generator can be used to facilitate shifting the gear system into a reverse gear position by applying a negative torque on the driveshaft to slow it down to a speed where the shift can occur—i.e., to reduce the engine speed so that the marine drive can shift into reverse gear more quickly. When a shift event, such as a shift to reverse gear, occurs at high engine speeds, inertia of the system prevents swift reduction of engine RPM, thus preventing the propulsion device from quickly shifting into neutral and then reverse. The inventors have implemented the electric starter-generator motor to apply additional negative torque on the driveshaft to reduce engine RPMs more quickly so that the shift event can occur. In order to slow down the engine, the starter-generator motor operates in a negative torque mode to increase the charge rate to the battery and, thereby, apply a negative torque on the driveshaft. Further, the inventors have recognized that the starter-generator can then be operated to apply sufficient torque to initiate reverse rotation of the propeller. To that end, once the engine RPM is sufficiently low enough and the gear system effectuates the shift to the reverse gear position, the starter-generator may then be switched to a positive torque mode where it is powered by the battery to exert additional positive torque on the driveshaft to assist in initiating reverse rotation of the propeller shaft.

FIG. 1 depicts an exemplary remote control 25 and marine propulsion device 12 on a marine vessel 11. The propulsion device 12 includes an internal combustion engine (ICE, or engine) 14. In the examples shown and described herein below, the marine propulsion device 12 is an outboard motor; however the concepts of the present disclosure are not limited for use with outboard motors and can be implemented with other types of marine propulsion devices, such as inboard motors, sterndrives, hybrid electric marine propulsion systems, pod drives and/or the like. In the examples shown and described, the marine propulsion device 12 has an internal combustion engine 14 causing rotation of a driveshaft 16 to thereby cause rotation of a propeller shaft 18. It will be understood to a person having ordinary skill in the art reviewing this disclosure that the "driveshaft" 16 as referred to herein may also include a crankshaft portion translating motion from the engine 14. A propeller 20 connected to and rotating with the propeller shaft 18 propels the marine vessel 11 to which the marine propulsion device 12 is connected. The direction of rotation of propeller shaft 18 and propeller 20 is changeable by a gear system 22 having a clutch 32, which in the example shown is a conventional dog clutch; however many other types of clutches or transmissions can instead or also be employed. As is conventional, the clutch is actuated by a shift rod 24 between forward gear position to effectuate a forward thrust on the marine vessel 11, neutral position where no thrust is exerted, and reverse gear position to effectuate a rearward thrust on the marine vessel 11.

The propulsion device 12 includes an electric starter-generator motor 30 connected in a torque transmitting relationship to the driveshaft 16. It will be understood that the starter-generator motor 30 could be connected at any location on the driveshaft 16 (including at a crankshaft portion of the driveshaft 16), or could be connected at an alternate location on the drive system, such as to a flywheel. During normal operation of the internal combustion engine 14, the starter-generator motor 30 acts as a generator for charging the battery 15. Specifically, the starter-generator motor 30 is operable in a negative torque mode where it draws energy from the driveshaft 16, thereby exerting a negative torque thereon, and generates a charge to the battery 15. The starter-generator motor 30 can also be switched into a positive torque mode where it draws current from the battery 15 in order to exert a positive torque on the driveshaft 16 (e.g., to act as a starter motor). Examples of starter-generator motors in torque transmitting arrangements with internal combustion engines are exemplified and described at U.S. Pat. Nos. 6,699,081 and 6,098,584, which have been incorporated herein by reference. However, such examples are not limiting and a person having ordinary skill in the art will understand that other arrangements of starter-generator motors 30 and engines 14 are possible and within the scope of the present disclosure.

In the depicted embodiment, the shift and throttle operator control for the propulsion device 12 is provided by the remote control 25 having operator control lever 26, which in the example is a combination shift/throttle lever that is pivotally movable to control both shift position of the gear system 22 and the throttle for the internal combustion engine 14. In the depicted embodiment, the shift and throttle control system is a drive-by-wire system having electronic shift and throttle control provided by the engine control module (ECM) 36. Such drive-by-wire systems are known in the art, examples of which are disclosed at U.S. Pat. No. 9,103,287 and U.S. patent application Ser. No. 15/239,516, which are incorporated herein by reference in their entireties. The ECM receives information about the position of the control lever 26 from the lever position sensor 27 in the remote control 25. The ECM 36 then controls the throttle and fueling characteristics, as well as the shift position of the gear system 22. In a drive-by-wire system, the ECM 4 may delay executing a shift command from the remote control 25 to shift into reverse gear until the engine speed has sufficiently decreased and conditions are such that the shift is unlikely to cause the engine 14 to stall. Specifically, the ECM 36 communicates to a shift actuator 23 which variously moves the shift rod 24 to move the clutch 32 between the forward gear position, the neutral position which effectuates a forward thrust on the marine vessel 11, the neutral state where no thrust is effectuated, and the reverse gear position effectuating a reverse thrust on the marine vessel 11. The ECM 36 receives information regarding the shift position of the shift rod 24 and/or clutch 32 from a position sensor associated with the gear system 22. The information regarding shift position may be transmitted from the position sensor 21 to the actuator 23 which then communicates it to the ECM 36, or the ECM 36 may receive position information directly from position sensor 21.

In other embodiments, the remote control 25 is connected to the shift rod 24 via mechanical linkages that physically connect the control lever 26 to the shift rod 24 such that movement of the control lever 26 actuates movement of the shift rod 24, as is conventional and is also exemplified in U.S. Pat. Nos. 4,753,618, 4,952,181, and 9,043,058. As shown in the example of FIG. 1, the combination shift/throttle lever is pivotally movable between a reverse wide open throttle position 26*a*, a reverse detent position (zero throttle) 26*b*, a neutral position 26*c*, a forward detent position (zero throttle) 26*d*, and a forward wide open throttle position 26*e*, as is conventional. The remote control 25 typically is located remote from the marine propulsion device 12, for example at the helm of the marine vessel 11.

The various aspects of the propulsion system 12 of FIG. 1 are monitored and controlled by the ECM 36, which is a programmable control module that includes a processor 38 and memory 40. The ECM 36 monitors and controls one or more operational characteristics of the propulsion device 12, including engine 14, and other elements on the marine vessel 11 by sending and receiving control signals via communication links 50 between the ECM 36 and each of the various elements in the system. The ECM 36 may be located anywhere on the propulsion device 12 or elsewhere on the marine vessel 11 remote from the propulsion device 12. The ECM 36 communicates with the various components of the propulsion device 12 and the marine vessel 11 via communication links 50, which may be wired or wireless signal communication means. For example, the communication links 50 may comprise one or more of a CAN bus as part of a CAN Kingdom Network, or another type of physical communication cables, which may be implemented as serial communication buses or as separate communication buses or cables, that operate in parallel. Alternatively or additionally, one or more of the communication links 50 may be a wireless link operating according to a wireless protocol, such as on a Wi-Fi-compliant wireless local area network (WLAN), Bluetooth, Bluetooth low energy (BLE), near field communication (NFC), ANT, or according to any other wireless protocol.

As is conventional, the control module comprises the processor 38, which retrieves and executes software from memory 40 in order to provide such control functions. As used herein, the term module may refer to, be part of, or include an application-specific integrated circuit (ASIC), an electronic circuit, a combinational logic circuit, a field programmable gate array (FPGA), a processor (shared, dedicated, or group) that executes code, or other suitable components that provide the described functionality, or a combination of some or all of the above, such as in a system-on-chip. The term module may include memory (shared, dedicated, or group) that stores code executed by the processor. The term code, as used herein, may include software, firmware, and/or microcode, and may refer to programs, routines, functions, classes, and/or objects. The term shared, as used above, means that some or all code from multiple modules may be executed using a single (shared) processor. In addition, some or all code to be executed by multiple different processors may be stored by a single (shared) memory. The term group, as used above, means that some or all code comprising part of a single module may be executed using a group of processors. Likewise, some or all code comprising a single module may be stored using a group of memories.

A person having ordinary skill in the relevant art will understand in light of this disclosure that the ECM 36 may be a single control module with one processor 38, or may be divided over two or more processing devices or subsystems that cooperate to execute the control methods described herein. Likewise, while the control methods are described herein as being executed on the ECM 36, a person having ordinary skill in the art will understand in light of this disclosure that such methods may be executed on other control systems or modules, such as at a typical helm control module (HCM) or on an application-specific control module dedicated to controlling the starter-generator 30 or the like.

Various sets of control instructions may be embodied in computer executable instruction sets that can be called and executed on the processor 38 in order to perform various control functions, including those described herein. The systems and methods described herein may be implemented by one or more computer programs executed by one or more processors, which may all operate as part of a single control module. The computer programs include processor-executable instructions that are stored on a non-transitory tangible computer readable medium. The computer programs may also include stored data. Non-limiting examples of the non-transitory tangible computer readable medium are non-volatile memory, magnetic storage, and optical storage.

The ECM 36 receives information regarding the speed of the marine vessel from vessel speed sensor 41. The vessel speed sensor 41 may be, for example, a pressure-type sensor, such as a pitot tube, a paddle wheel-type sensor, or any other speed sensor appropriate for sensing the actual speed of the marine vessel 11. Alternatively or additionally, the vessel speed may instead be determined based on readings from a GPS device that calculates speed by determining how far the marine vessel 11 has travelled in a given amount of time. In still another embodiment, the vessel speed may be estimated based on engine RPM and/or engine load over time.

Figure 2:
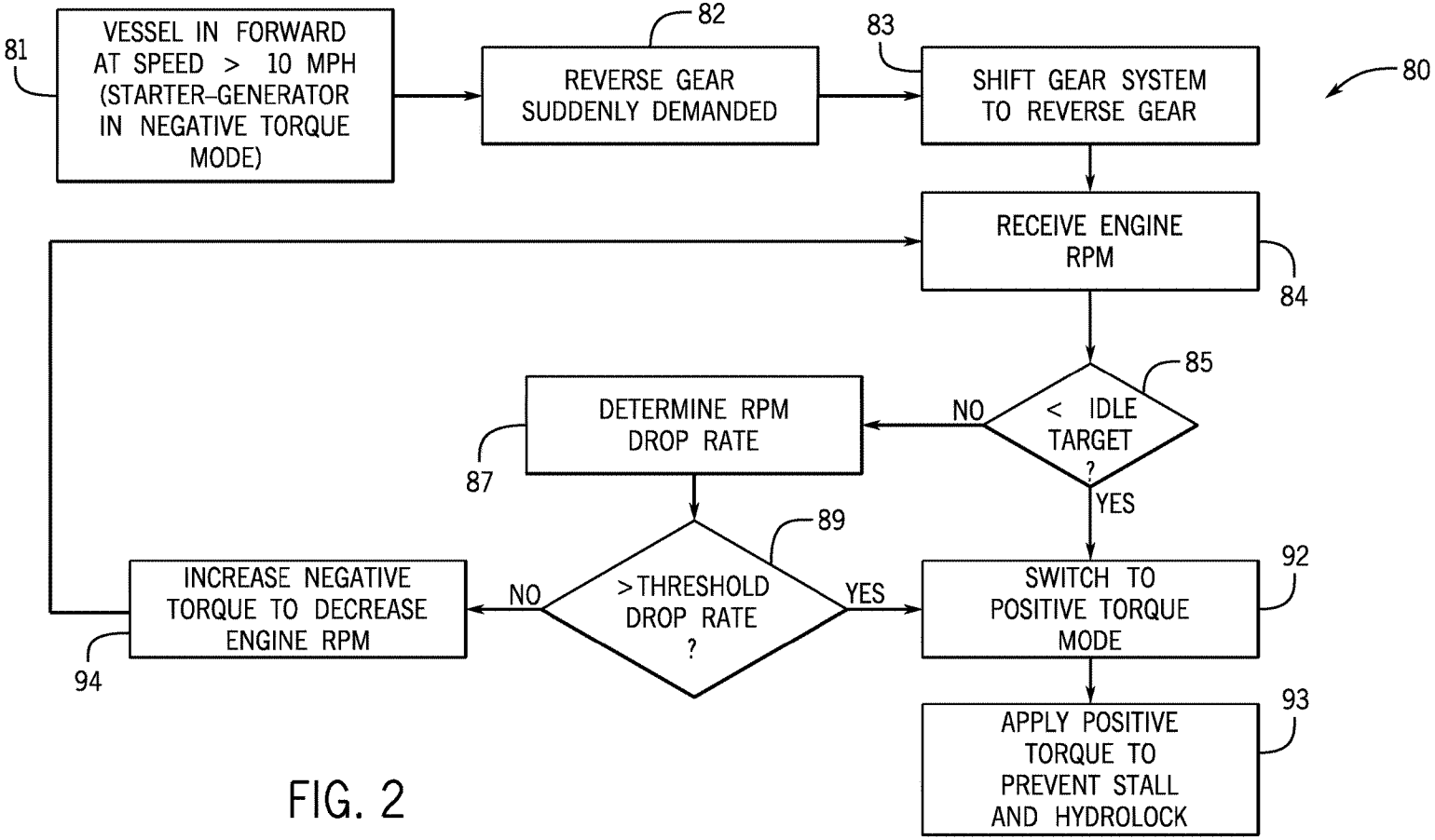
FIG. 2 is a flow chart depicting one embodiment of a method of controlling a starter-generator motor in accordance with the present disclosure.

FIG. 2 illustrates one embodiment of a method 80 for controlling the starter-generator motor 30. Step 81 assumes that the vessel is in forward gear position and is travelling at a speed greater than a hydrolock threshold speed, which in the depicted embodiment is exemplified as 10 mph. At step 81 the starter-generator motor 30 is in negative torque mode, and is thus exerting a negative torque on the driveshaft 16 and generating a charge to the battery 15. At step 82 in the hypothetical scenario, a reverse gear position is suddenly demanded. For example, the control lever 26 of the remote control 25 may have been suddenly pulled back from a forward gear throttle position (such as between position 26*d* and 26*e*) to a reverse gear throttle position (such as between 26*b* and 26*a*). The gear system 22 is then shifted into reverse gear at step 83. The engine RPM value is received at step 84, such as received at the ECM 36 from an engine RPM sensor that monitors revolution rate of the driveshaft 16 and generates an engine RPM signal in response thereto. For example, an engine RPM value may be provided by a position sensor and encoder on or associated with the driveshaft 16, as is conventional. Step 85 determines whether the engine RPM is less than an idle target RPM, which is a preset target RPM value used by an idle controller as a target engine speed for controlling the engine during normal idle conditions.

If the engine RPM is less than the idle target RPM value, then a stall event has occurred or is potentially about to occur. The system reacts by switching the starter-generator 30 into positive torque mode at step 92, to apply positive torque on the driveshaft 16 at step 93 in order to prevent hydrolock.

If at step 85 the engine RPM is not below the idle target, then step 87 is executed to determine the RPM drop rate, which is the magnitude of RPM decrease per unit time. The RPM drop rate describes the current trajectory of the RPM, such as the numeric derivative of the RPM versus time or other calculation method. For example, the RPM drop rate may be calculated based on comparison of the most recent two RPM measurements, and thus may be the difference between the two most recent RPM measurements over the period of time between the two measurements. Alternatively, the RPM drop rate may be calculated based on a recent set of engine speed measurements, such as an average difference between each of a most recent predetermined number of engine RPM measurements (e.g., 3, 5, 10, etc.) over the measurement period.

The RPM drop rate is then compared to a threshold drop rate at step 89 to determine whether the RPM drop rate exceeds the threshold drop rate. For example, the threshold drop rate may be a calibrated value for a particular engine determined as an amount that is a likely indicator that the engine 14 has stalled or is likely to stall. If step 89 is true then the starter-generator motor 30 is switched to the positive torque mode at step 92 and applies a positive torque to the driveshaft 16 at step 93 in an effort to prevent a stall from occurring and to ward off hydrolock if a stall does occur. If, on the other hand, the RPM drop rate is not less than the threshold drop rate at step 89, then the starter-generator motor 30 continues to be operated in the negative torque mode.

Further, in some embodiments the starter-generator 30 may be operated to increase the negative torque on the driveshaft 16 at step 94 in order to decrease engine RPM more quickly (however, not so quickly that the engine will stall). As described above, the charging activity of the starter-generator 30 can be increased to help slow down the engine RPM so that the automatic shift control system and method can operate to shift the gear system 22 out of forward gear into neutral position, and then into reverse gear as quickly and smoothly as possible. Further, in some embodiments the starter-generator 30 may be switched to the positive torque mode to provide additional torque during the high torque demand period of initiating reverse propulsion, as is described above. The system then returns to step 84 where it receives an updated engine RPM.

Figure 3:
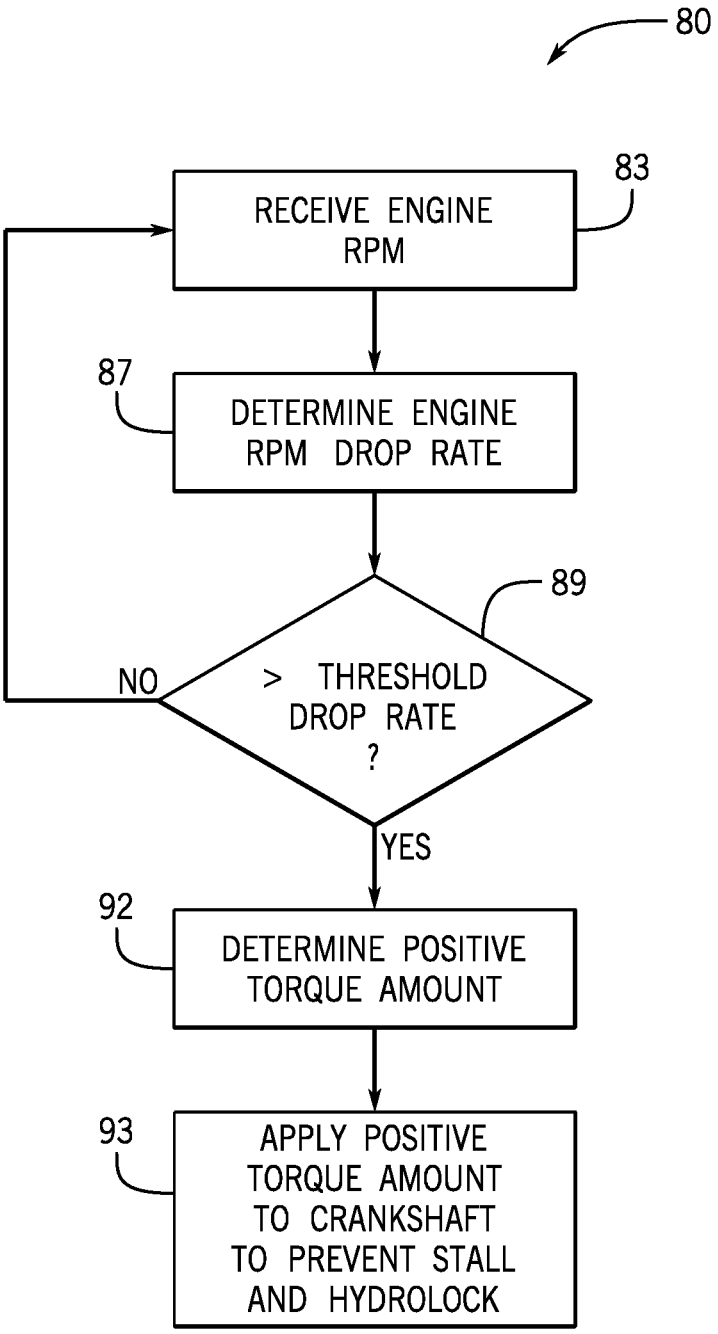
FIG. 3 is a flow chart depicting another embodiment of a method of controlling a starter-generator motor in accordance with the present disclosure.

FIG. 3 depicts another embodiment of a method 80 of controlling a starter-generator motor 30 in a marine propulsion device 12. Engine RPM is received at step 83 and an engine RPM drop rate is determined at step 87. The engine RPM drop rate is compared to the threshold drop rate at step 89 to determine whether the engine RPM drop rate is less than the threshold drop rate. If not, then the steps are executed again to continue monitoring the engine RPM drop rate. If the threshold drop rate is exceeded, then the starter-generator 30 is switched to a positive torque mode and a positive torque amount is determined at step 92. For example, the positive torque amount may be determined based solely on the engine RPM drop rate, or it may be determined based on the engine RPM drop rate in combination with other values, such as engine RPM, vessel speed, throttle demand value, throttle position (position of the throttle valve), or the like. For example, the positive torque amount may be determined by accessing a lookup table containing positive torque amounts based on one or more input values. However, a person having ordinary skill in the art will recognize in light of this disclosure that other methods may be executed to determine the positive torque amount, such as by implementing an equation or a model, or by utilizing a single set value. To provide just one additional example, the positive torque amount may be determined by utilizing a torque multiplier based on a difference between the current engine RPM and an idle set point, or other RPM threshold, in order to prevent engine stall.

Figure 4A:
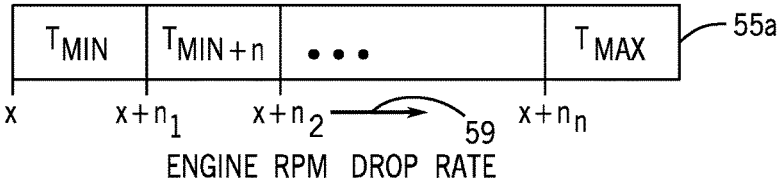
FIGS. 4A-4C depict exemplary lookup tables for use in various embodiments of methods for controlling a starter-generator motor in accordance with the present disclosure.
Figure 4B:
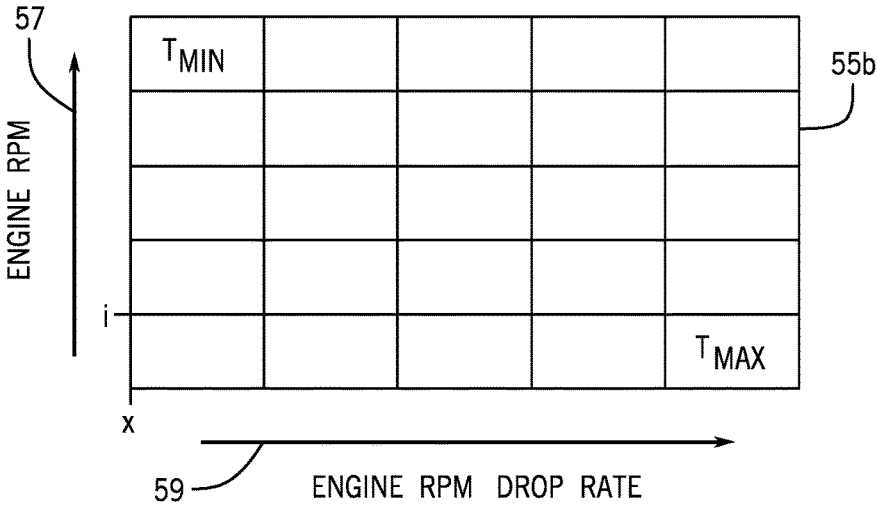
Figure 4C:
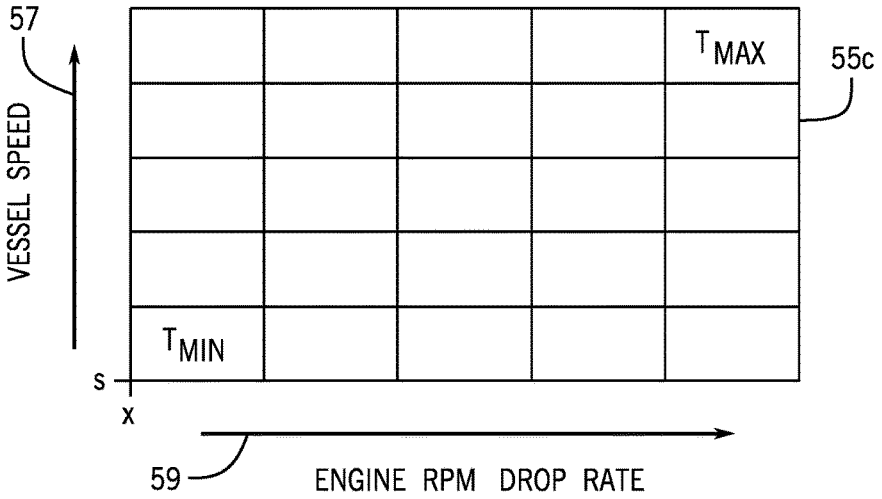

FIGS. 4A-4C provide exemplary lookup tables 55*a*-55*c* that could be utilized for such purposes, though a person having ordinary skill in the art will understand in view of this disclosure that other lookup table configurations could be used effectively to determine the torque amount provided by the starter-generator motor 30. FIG. 4A provides a lookup table 55*a* of positive torque amounts T based on engine RPM drop rate values. The lookup table 55*a* provides torque amounts $T_{min}$ through $T_{max}$ based on ranges of RPM change values. The RPM change amounts may increase linearly or nonlinearly along the horizontal axis 59. In the embodiment, the table begins at the threshold drop rate value x and provides a positive torque amount $T_{min}$ for engine RPM drop rate values between the threshold drop rate value x and a higher drop rate value $x+n_1$, which may be any appropriate drop rate increment and may be determined as part of the calibration strategy for establishing the lookup table 55*a*. Likewise, a larger positive torque amount $T_{min+n}$ may be provided for engine RPM drop rates falling within a drop rate range between $x+n_1$ and $x+n_2$, and so on. The lookup table 55*a* may be configured such that a maximum torque $T_{max}$ that the starter-generator motor 30 is capable of is associated with the highest RPM drop rate values, such as those values that indicate that the engine 14 has stalled.

FIG. 4B depicts another exemplary lookup table 55*b* which provides positive torque amounts T between $T_{min}$ and $T_{max}$ based on engine RPM drop rate and engine RPM. Specifically, the depicted lookup table 55*b* is organized by increasing drop rate increments along the horizontal axis 59 and increasing engine RPM increments along the vertical axis 57. In the exemplary embodiment of the calibrated lookup table 55*b*, the minimum positive torque amount $T_{min}$ is provided for engine RPM values in the highest range of expected engine RPMs and for the lowest range of drop rate values. Thus, the least amount of positive torque is provided where the engine RPM is in the highest range and the drop rate is above the drop rate threshold x and the current, or last measured, engine RPM value is still relatively high. The positive torque amount T contained in the table 55*b* then increases as the engine RPM decreases and as the engine RPM drop rate increases. The highest positive torque amount that the starter-generator motor 30 is capable of, or specified for, $T_{max}$ is assigned where the engine RPM drop rate is on the highest end of expected rates of change and where the engine RPM is below the idle target RPM i. However, a person having ordinary skill in the art will recognize in light of this disclosure that lookup table 55*b* may provide other relative arrangements of positive torque values T with respect to engine RPM drop rate and engine RPM. Likewise, the positive torque amount may be determined by other methods not employing a lookup table, such as using calculation equation.

FIG. 4C provides another example of a lookup table 55*c* providing positive torque values T based on increasing engine RPM drop rate values on the horizontal axis 59 and increasing vessel speed values on the vertical axis 57. In the depicted embodiment, the positive torque amounts increase as the engine RPM drop rate increases and as the vessel speed increases. Thus, a minimum positive torque amount $T_{min}$ is applied for vessel speeds in the range immediately above the lower speed threshold s where hydrolock could occur (e.g., 10 mph) and where the engine RPM drop rate is in the range immediately above the drop rate threshold x. The positive torque amount T provided in the lookup table 55*c* increases to the maximum positive torque amount $T_{max}$ at high vessel speeds and high engine RPM rates of change. Thus, a maximum torque is provided where the highest possibility of hydrolock is indicated—i.e., at high vessel speeds where the engine RPM drop rate is very high and thus indicates that the engine 14 has stalled or is very likely to stall.

Figure 5A:
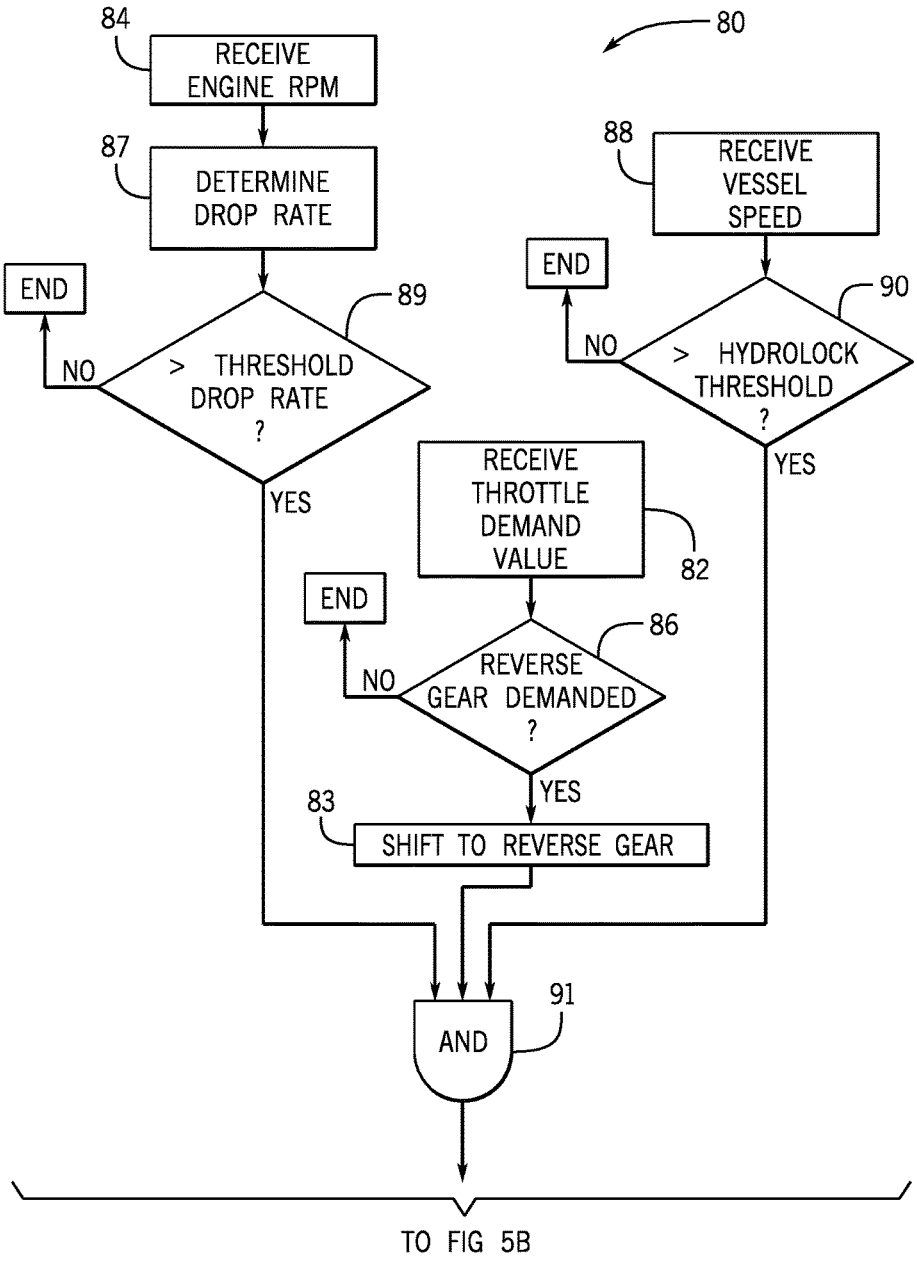
FIGS. 5A-5B provide a flow chart depicting another embodiment of a method of controlling a starter-generator motor in accordance with the present disclosure.
Figure 5B:
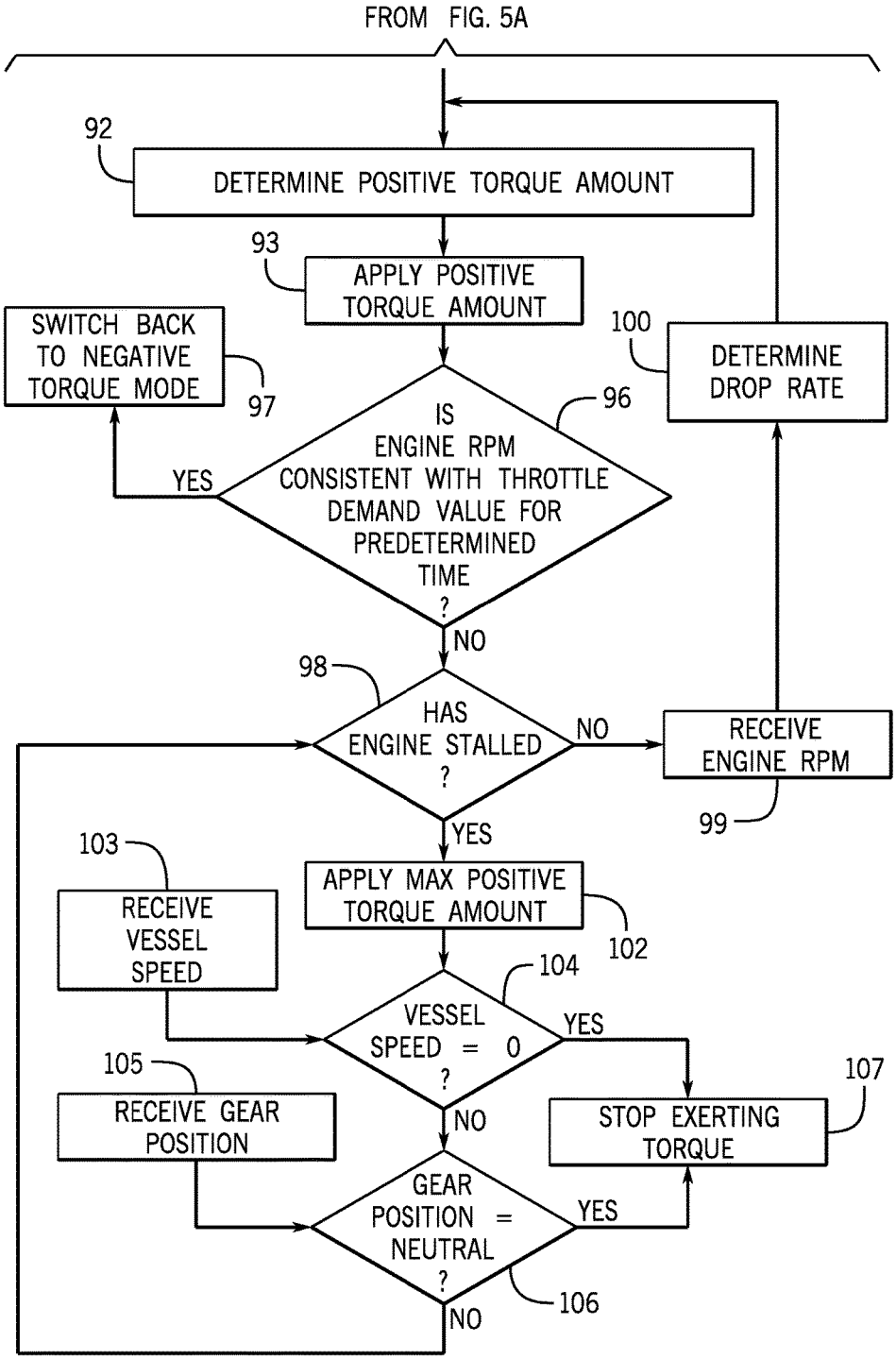

FIGS. 5A and 5B provide a flow chart depicting another embodiment of a method 80 for controlling the starter-generator motor 30. Engine RPM is received at step 84 and a drop rate is determined at step 87 based on the difference between the received engine RPM value and one or more previous engine RPM values. Step 89 determines whether the drop rate is greater than a threshold drop rate. At step 82 a throttle demand value is received, and the throttle demand value is assessed at step 86 to determine whether a reverse gear position is demanded, such as by the remote control 25. A vessel speed is received at step 88, and then assessed at step 90 to determine whether the vessel speed is greater than a hydrolock threshold speed value. The gear system is then shifted into reverse gear at step 83. If any of the inquiries at steps 89, 86, or 90 are false, then the assessment cycle ends and returns to the receiving steps to continually monitor the engine RPM, throttle demand value, and vessel speed.

If all of the requirements of steps 89, 86, and 90 are met, as represented by the AND gate at step 91, then the subsequent steps are executed, as exemplified at FIG. 5B. The starter-generator motor 30 is switched to positive torque mode at step 92 and a positive torque amount is determined. The positive torque amount is applied at step 93. While the positive torque amount is applied, step 96 is executed to determine whether the engine RPM is now consistent with a throttle demand value for at least a predetermined time. The inquiry of step 96 will be based on subsequent engine RPM values received, as the engine RPM is continually monitored. If the engine RPM is consistent with the throttle demand value for a predetermined time, then it can be assumed that the combustion strategy has caught up with the throttle demand and the positive torque amount is no longer necessary. Accordingly, step 97 is executed to switch the starter-generator motor 30 back to the negative torque mode.

However, if step 96 is false and the engine RPM remains less than the throttle demand value, then step 98 is executed to assess whether the engine has stalled. If the engine has not stalled, then a new engine RPM value is received at step 99 and a new drop rate value is determined at step 100. Steps 92 through 98 are then re-executed until either the combustion strategy takes over and the engine RPM becomes consistent with the throttle demand value, or the engine stalls.

If the engine stalls, then the starter-generator motor 30 is controlled at step 102 to apply a maximum positive torque amount on the driveshaft 16 in an effort to prevent the driveshaft from being rotated backwards causing hydrolock. An updated vessel speed is received at step 103 and an updated gear position is received at step 105. In the depicted embodiment, the maximum positive torque amount is applied until either the vessel speed equals zero at step 104, the gear system 22 is in a neutral position at step 106, or the engine is restarted and thus the stall conditions of step 98 are no longer met. If the vessel speed is equal to zero (or alternatively, below some predetermined threshold such as the hydrolock threshold) and the gear position is equal to neutral, then the risk of hydrolock has subsided and step 107 is executed to stop the exertion of positive torque by the starter-generator motor 30.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A marine propulsion device comprising: an internal combustion engine driving a driveshaft into rotation, configured to propel a marine vessel;

a starter-generator motor in a torque transmitting relationship with the driveshaft, wherein the starter-generator motor is alternately operable in a positive torque mode where it is powered by a battery to exert a positive torque on the driveshaft, and in a negative torque mode where it exerts a negative torque on the driveshaft and generates a charge to the battery;

a control module configured to:

receive an engine RPM;

determine an engine RPM drop rate;

determine that the engine RPM drop rate exceeds a threshold drop rate; and operate the starter-generator motor in the positive torque mode based on the engine RPM drop rate when the engine RPM drop rate exceeds the threshold drop rate.

2. The marine propulsion device of claim 1, wherein the control module is further configured to operate the starter-generator motor in the positive torque mode to exert a positive torque amount on the driveshaft based on the engine RPM drop rate, wherein the positive torque amount increases as the engine RPM drop rate increases.

3. The marine propulsion device of claim 2, wherein the positive torque amount is calibrated to maintain the engine RPM drop rate below the threshold drop rate.

4. The marine propulsion device of claim 3, wherein the control module determines the positive torque amount by accessing a lookup table containing positive torque amounts based on engine RPM drop rate values.

5. The marine propulsion device of claim 1, wherein the control module is further configured to:

determine that the engine RPM is below an idle target RPM; and operate the starter-generator motor in the positive torque mode to exert a positive torque amount on the driveshaft based on the difference between the engine RPM and the idle target RPM.

6. The marine propulsion device of claim 5, wherein the control module determines the positive torque amount by accessing a lookup table containing positive torque amounts based on engine RPM values and engine RPM drop rate values.

7. The marine propulsion device of claim 1, wherein the control module is further configured to:

receive a throttle demand value;

determine whether a reverse gear position is demanded; and if a reverse gear position is demanded, operate the starter-generator motor in the positive torque mode to exert a positive torque amount on the driveshaft based on at least the engine RPM drop rate.

8. The marine propulsion device of claim 1, wherein the control module is further configured to:

receive a gear position;

operate the starter-generator motor in the positive torque mode to exert a positive torque amount on the driveshaft based on at least the engine RPM drop rate until the gear position is neutral.

9. The marine propulsion device of claim 1, wherein the control module is further configured to:

receive a vessel speed; and operate the starter-generator motor in the positive torque mode to exert a positive torque amount on the driveshaft based on at least the engine RPM drop rate and the vessel speed.

10. The marine propulsion device of claim 1, wherein the control module is further configured to:

determine that the internal combustion engine has stalled; and operate the starter-generator motor in the positive torque mode to exert a maximum torque amount on the driveshaft to prevent negative rotation of the driveshaft.

11. The marine propulsion device of claim 10, wherein the control module is further configured to operate the starter-generator motor in the positive torque mode until the internal combustion engine is restarted or a gear system is in a neutral position.

12. The marine propulsion device of claim 10, wherein the control module is further configured to:

receive a gear position;

determine that the gear position equals a reverse gear position;

determine that the engine RPM is above a shift threshold RPM; and operate the starter-generator motor in the negative torque mode to apply a negative torque amount on the driveshaft based on the engine RPM until the engine RPM is below the shift threshold RPM.

13. A method of controlling a starter-generator motor on a marine propulsion device containing an internal combustion engine and configured to propel a marine vessel, wherein the starter-generator motor is alternately operable in a positive torque mode where it is powered by a battery to exert a positive torque on a driveshaft, and in a negative torque mode where it exerts a negative torque on the driveshaft and generates a charge to the battery, the method comprising:

receiving an engine RPM;

determining an engine RPM drop rate;

determining that the engine RPM drop rate exceeds a threshold drop rate; and operating the starter-generator motor in the positive torque mode based on the engine RPM drop rate when the engine RPM drop rate exceeds the threshold drop rate.

14. The method of claim 13, further comprising operating the starter-generator motor in the positive torque mode to exert a positive torque amount on the driveshaft based on the engine RPM drop rate, wherein the positive torque amount is a calibrated torque amount intended to maintain the engine RPM drop rate below the threshold drop rate.

15. The method of 14, further comprising determining the positive torque amount by accessing a lookup table containing positive torque amounts based on engine RPM drop rate values.

16. The method of claim 13, further comprising:

determining that the engine RPM is below an idle target RPM; and operating the starter-generator motor in the positive torque mode to exert a positive torque amount on the driveshaft based on the difference between the engine RPM and the idle target RPM.

17. The method of claim 13, further comprising:

receiving a throttle demand value;

determining whether a reverse gear position is demanded; and operating the starter-generator motor in the positive torque mode to exert a positive torque amount on the driveshaft based at least on engine RPM drop rate until the engine RPM is consistent with the throttle demand value for a predetermined period of time.

18. The method of claim 13, further comprising:

receiving a gear position; and operating the starter-generator motor in the positive torque mode to exert a positive torque amount on the driveshaft based on at least the engine RPM drop rate until the gear position is neutral.

19. The method of claim 13, further comprising:

receiving a vessel speed; and operating the starter-generator motor in the positive torque mode to exert a positive torque amount on the driveshaft based on at least the engine RPM drop rate and the vessel speed.

20. The method of claim 13, further comprising:

determining that the internal combustion engine has stalled; and operating the starter-generator motor in the positive torque mode to exert a maximum torque amount on driveshaft to prevent negative rotation of the driveshaft.

* * * * *